US009616684B2

(12) United States Patent
Ruiz Vega et al.

(10) Patent No.: US 9,616,684 B2
(45) Date of Patent: Apr. 11, 2017

(54) DIRECT PRINTING METHOD FOR ENAMELLING AND DECORATING

(71) Applicant: TORRECID, S.A., Alcora (Castellon) (ES)

(72) Inventors: Oscar Ruiz Vega, Alcora (ES); Carlos Concepcion Heydorn, Alcora (ES); Juan Vicente Corts Ripoll, Alcora (ES); Francisco Sanmiguel Roche, Alcora (ES)

(73) Assignee: TORRECID, S.A., Alcora (Castellón) (ES)

( * ) Notice: Subject to any disclaimer, the term of this patent is extended or adjusted under 35 U.S.C. 154(b) by 0 days.

(21) Appl. No.: 14/905,572

(22) PCT Filed: Jul. 7, 2014

(86) PCT No.: PCT/ES2014/070550
§ 371 (c)(1),
(2) Date: Jan. 15, 2016

(87) PCT Pub. No.: WO2015/007936
PCT Pub. Date: Jan. 22, 2015

(65) Prior Publication Data

US 2016/0167400 A1 Jun. 16, 2016

(30) Foreign Application Priority Data

Jul. 16, 2013 (ES) ..... 201331076

(51) Int. Cl.
*B41J 11/00* (2006.01)
*B41M 5/00* (2006.01)
(Continued)

(52) U.S. Cl.
CPC ..... *B41J 11/002* (2013.01); *B41M 5/007* (2013.01); *B41M 5/0052* (2013.01); *B41M 5/38221* (2013.01); *B41M 7/00* (2013.01)

(58) Field of Classification Search
CPC ..... B41J 11/002
See application file for complete search history.

(56) References Cited

U.S. PATENT DOCUMENTS 5,407,474 A 4/1995 Airey et al.
6,357,868 B1 3/2002 Pfaff et al.
(Continued)

FOREIGN PATENT DOCUMENTS

ES 2 386 267 A1 8/2012
WO 2011/070079 A1 6/2011

OTHER PUBLICATIONS

International Search Report for PCT/ES2014/070550 dated Sep. 17, 2014.

*Primary Examiner* — Jason Uhlenhake
(74) *Attorney, Agent, or Firm* — Sughrue Mion, PLLC

(57) ABSTRACT

The invention relates to a direct printing method for enamelling and/or decorating on surfaces in general (ceramic, glass or metallic materials, inter alia), which are subjected to heat treatment following printing, consisting of transferring an enamel/ink, by means of the use of a device for emitting energy in the form of electromagnetic waves, preferably laser, from a carrier vehicle to the printing surface without any contact between said vehicle and the printing surface. The heat treatment, which is carried out at temperatures higher than 500° C., is used for the adherence of the enamel/ink to the substrate, producing the final ceramic and/or chromatic effect.

19 Claims, 2 Drawing Sheets

(51) Int. Cl.
*B41M 5/382* (2006.01)
*B41M 7/00* (2006.01)

(56) References Cited

U.S. PATENT DOCUMENTS

| | | | | |
|---|---|---|---|---|
| 7,976,906 | B2 | 7/2011 | Eron | |
| 2005/0021888 | A1 | 1/2005 | Yatziv et al. | |
| 2005/0264600 | A1 | 12/2005 | Moffatt et al. | |
| 2007/0237886 | A1* | 10/2007 | Dijksman | B41J 3/4071 427/8 |
| 2011/0298878 | A1 | 12/2011 | Kleine Jäger et al. | |
| 2012/0164777 | A1 | 6/2012 | Kleine Jaeger et al. | |
| 2012/0281043 | A1* | 11/2012 | Hudd | B41J 2/21 347/37 |
| 2014/0035995 | A1* | 2/2014 | Chou | C09D 11/101 347/20 |

* cited by examiner

DIRECT PRINTING METHOD FOR ENAMELLING AND DECORATING

CROSS REFERENCE TO RELATED APPLICATIONS

This application is a National Stage of International Application No. PCT/ES2014/070550 filed Jul. 7, 2014, claiming priority based on Spanish Patent Application No. P201331076 filed Jul. 16, 2013, the contents of all of which are incorporated herein by reference in their entirety.

OBJECT OF THE INVENTION

A direct printing method for enamelling and/or decorating on surfaces in general, which are subjected to a heat treatment following printing, consisting of transferring an enamel/ink, by means of the use of a device for emitting energy in the form of electromagnetic waves, from a carrier vehicle to the printing surface.

The heat treatment is necessary for the adherence of the enamel/ink to the substrate, producing the final ceramic and/or chromatic effect. To this end, said heat treatment is carried out at temperatures higher than 500° C.

DESCRIPTION OF THE STATE OF THE ART

Currently, there are various application processes and different compositions for enamelling and decorating surfaces of any kind, both porous and non-porous. The ink injection technique has been used for years in the ceramics and glass industries to print decorative motifs, having partially replaced other decoration techniques such as screen printing, rotogravure, etc.

These injection inks are characterised in that they contain mainly inorganic pigment particles, which provide the necessary colours and shades and, optionally, frits that accompany the ceramic pigments, as disclosed in U.S. Pat. No. 7,976,906, U.S. Pat. No. 6,357,868 and U.S. Pat. No. 5,407,474. However, ink injection technology, for the purpose of ensuring proper printing, requires the particles that compose the inks to be submicrometric, being highly advisable that it does not exceed 500 nanometers. This implies a limitation, as it is not possible to achieve a broad and intense range of chromatic and ceramic effects with such small particles.

At present, the objective also includes leveraging digital technology for enamelling ceramic tiles. Thus, Spanish patent application P201231722 discloses a series of enamels which are applied by means of digital injection technology using printheads based on the Drop-on-Demand (DOD) system, aimed at enamelling large ceramic tiles that require a low amount of enamel, less than 200 g/m$^2$. In this case, digital injection technology, in addition to the aforementioned limitations regarding particle size that restrict the compositions to be used, has the drawback that it is not possible to deposit high weights. These two aspects limit the finish possibilities of the ceramic products, preventing the entire current range and variety from being achieved, mainly when aiming to obtain products having ceramic effects such as, inter alia, metallic, lustre or mica effects.

In the context of the present invention, the term 'ceramic effect' includes any effect obtained from a mixture of frits or raw materials or ceramic pigments or a combination thereof, which is subjected to heat treatment either to obtain completely coated surfaces or selected zones. Likewise, it includes concepts known to any person skilled in the art such as enamelling, glazing, vitrification or similar.

While patent ES2386267 and patent application P201330061 disclose digital enamel inks and digital enamels, respectively, which enable the application of high weights using digital injection technology, the image quality achieved is not sufficiently high to fulfil the requirements required in this regard from most ceramics industry products. Consequently, the field of application of both patents is limited to ceramic products in which high image quality of the enamel deposited is not required or simply requires a continuous layer of enamel to be deposited throughout the surface.

Furthermore, patent US2005/021888 discloses a method for printing a composition with the help of an electromagnetic wave-emitting device, preferably laser, which gives rise to a change in the volume and/or position of the printing composition with the help of said laser radiation-absorbing bodies. Said patent US2005/0212888 discloses an indirect printing method characterised by a double transfer of the printing composition, firstly, from the carrier vehicle of said composition to a second carrier vehicle, by means of a change in volume and/or position of the composition and, secondly, from the latter carrier vehicle to the printing surface by means of contact. This method is unviable in the ceramics industry, since the use of substrates having more or less pronounced reliefs is common and, therefore, contact enamelling and/or decoration makes it impossible to access the deep relief zones.

Also, patent US2005/0212888 does not disclose the distance to the printing surface in its method, an essential aspect in the enamelling and decoration of ceramic and glass products, both to ensure good image quality and to avoid contact between the printing element and the substrate in question due to the differences in thickness between different parts within the production process.

In order to achieve ceramic and glass products in the entire chromatic range and ceramic effects used in the industry, the use of enamels/inks with solids contents in excess of 50% and with a particle size having a D90 of up to 40 micrometers is required, which gives rise to viscosities greater than 500 cPs. Patent US2005/0212888 discloses a printing composition characterised by a viscosity comprised between 0.05 and 0.5 Pas or, in other words, between 50 and 500 cPs, which prevents the execution of the entire range of chromatic and ceramic effects demanded by the industry.

Patent US2012/0164777 discloses a composition for laser printing conductive track, particularly intended for the production of solar cells and which is subjected to heat treatment subsequent to being deposited on the substrate, preferably semi-conductive. The frits, raw materials and pigments used in the enamelling and/or decoration of ceramic and glass products are not envisaged in this patent. In fact, the appropriate frit composition for the application disclosed in patent US2012/0164777 particularly comprises bismuth oxide, silicon oxide and/or tellurium oxide. In this regard, it is not appropriate for developing the properties and finishes required by the ceramics and glass industries.

Lastly, patent US2012/0164777 discloses the use of Au, Ag, Pt, Pd, W, Ni, In, $SnO_2$, TiC and $Ti_3N_4$ nanoparticles, in addition to organometallic compounds, preferably Al, Bi, Zn, V, B and Si, as laser absorbers. In this regard, it should be noted that while organometallic compounds are used in some special compositions to achieve metallic effects in the ceramics and glass industries, as disclosed in Spanish patent application P201231372, they are characterised in that they use organometallic compounds of precious metals instead of nanoparticles. Moreover, regardless of these special compositions that develop the aforementioned metallic effect, the nanoparticles described in patent US2012/0164777 cannot be used in a common composition for enamelling and/or decoration since they do not contribute any ceramic or chromatic effect in accordance with the requirements of the ceramics industry.

The object of the present invention fulfils the following characteristics:

- It is a printing method intended for enamelling and/or decorating on surfaces in general, subjected to a heat treatment following printing such as, inter alia, in the case of ceramic, glass or metal materials.
- It consists of transferring a printing enamel/ink from a carrier vehicle to the printing surface by means of the use of a device for emitting energy in the form of electromagnetic waves, preferably laser.
- It enables the development of a broad and intense chromatic range and ceramic effects once the enamelled and/or decorated substrates have been subjected to the corresponding heat treatment.
- It enables the enamel/ink weight (between 0 and 500 $g/m^2$) needed to achieve the industrially required finishes to be deposited, maintaining the image quality required by the end user.
- It is possible to apply enamel/ink both on smooth and raised surfaces.
- Contact between the carrier vehicle and the printing surface is not required.

DESCRIPTION OF THE INVENTION

The present invention relates to a direct printing method intended for enamelling and/or decorating on surfaces characterised in that they are subjected to heat treatment following printing. Specifically, said direct printing method according to the present invention consists of transferring a printing enamel/ink, by means of the use of a device for emitting energy in the form of electromagnetic waves, preferably laser, from a carrier vehicle to the printing surface, without there being contact between the aforementioned carrier vehicle of the enamel/ink and the printing surface. This fact represents a significant advantage, since the application of enamel/ink on any type of surface, such as for example ceramic and glass products, regardless of whether they are smooth or of the type of relief of said surface.

In addition, the present invention also envisages the advantage of enabling the deposit of enamel/ink both on selected zones and on the entire printing surface, such as for example the enamelling of ceramic tiles, depositing the weight required to achieve the common ceramic product finishes, which may be an interval between 0 and 500 $g/m^2$.

An essential aspect of the enamelling and/or decoration of ceramic and glass products is image quality. In this regard, the present invention establishes a maximum printing distance of 2.5 millimeters, since for greater distances accuracy is lost in the deposition of the enamel/ink, which produces blurry and poor-quality images. In order to avoid contact between the printer element and the substrate in question due to the differences in thickness that occur between different parts within the production process, the printing distance must not be less than 500 micrometers. Should the aforementioned contact occur, the printed image would be blurry, losing all its quality, with the additional ensuing risk of damaging parts of the printing device.

The present invention envisages the possibility that the printing surface is fixed and a movement is produced in an XYZ coordinate system of the energy-emitting device-enamel/ink carrier vehicle system, carrying out multi-pass printing. It is also envisaged that the energy-emitting device-enamel/ink carrier vehicle system will be fixed while the printing surface moves with movements in an XYZ coordinate system. In fact, the preferred invention is for the substrates to be enamelled/decorated to move in a conventional transport system, while the energy-emitting device-enamel/ink carrier vehicle system is fixed and in a direction transversal to that of the forward movement of the substrates. In this manner, the industrially required productivity is achieved, reaching printing surface transport system speeds of up to 70 m/min.

In another embodiment, it is the energy-emitting device-enamel/ink carrier vehicle system that moves along the Y-Z axes of an XYZ coordinate system while the surfaces move along the X-axis of an XYZ coordinate system.

The movements in an XYZ coordinate system, both the energy-emitting device-enamel/ink carrier vehicle system and the printing surface are aimed, in addition to the printing of the surface, at adapting to the optimum printing conditions and enabling general cleaning and maintenance operations.

The invention also envisages an adjustment of the enamel/ink to achieve a broad and intense chromatic range and ceramic effects once the enamelled and/or decorated substrates have been subjected to the corresponding heat treatment. In this regard, the enamel/ink according to the invention is characterised in that it has a solids content between 50% and 80%, preferably not less than 70%, and a particle size of up to 40 micrometers (D90). The use of the previously indicated solids contents and particle sizes gives rise to the fact that the specific enamels/inks for this application have viscosity values greater than 500 cPs and even up to 10,000 cPs.

In accordance with the present invention, the enamel and/or ink comprises at least one ceramic and/or chromatic part which is solid at room temperature, at least one absorbing substance, also solid at room temperature, and at least one part that is liquid at room temperature.

The part responsible for conferring the ceramic and/or chromatic effect comprises particles of frits or raw materials or ceramic pigments or a combination thereof. Specifically, the raw materials are selected from among sands, feldspars, aluminas, clays, zircon silicate, zinc oxide, dolomite, kaolin, quartz, barium carbonate, mullite, wollastonite, tin oxide, nepheline, bismuth oxide, borate products, colemanite, calcium carbonate, cerium oxide, cobalt oxide, copper oxide, iron oxide, aluminium phosphate, iron carbonate, manganese oxide, sodium fluoride, chromium oxide, strontium carbonate, lithium carbonate, spodumene, talc, magnesium oxide, cristobalite, rutile, anatase, bismuth vanadate, vanadium oxide, ammonium pentavanadate or a combination of thereof. The ceramic pigments are selected from among simple oxides, mixed oxides and crystalline structures of any chemical structure or composition.

In order to bring about the change in volume and/or position of the enamel/ink, it must be heated until it forms a bubble. To this end, an electromagnetic wave is made to strike the enamel/ink, preferably a laser beam. However, if it is only struck by the electromagnetic wave, the energy and/or the time required to form the bubble is very high and the energy is also dissipated along a very broad area of the enamel/ink. For the purpose of avoiding the previously described problems, the enamel/ink contains one or various absorbing elements characterised in that they absorb the wavelength or wavelength intervals emitted by the energy-emitting device. Therefore, the absorber enables the formation of the bubble using much less time and/or energy, as well as the generation of heat only in specific zones. In accordance with the present invention, the absorber element is characterised in that it is found in the enamel/ink in a percentage by weight of no more than 10%.

In this regard, the absorber element may be an additional element of the enamel/ink or even one of the components of the part responsible for producing the ceramic and/or chromatic effect, as in the case of frits, raw materials and ceramic pigments. Therefore, the absorber element is selected from among simple oxides, mixed oxides, crystalline structures of any chemical structure or composition, carbon, carbides, nitrides or a combination thereof.

According to the present invention, the liquid part is found in the enamel/ink in a percentage by weight between 20% and 50% and comprises solvents and/or additives. Among the solvents, these may be non-polar or have low, medium or high polarity. In accordance with the present invention, the non-polar solvent is selected from among linear or branched aliphatic hydrocarbons, aromatic hydrocarbons, naphthenic hydrocarbons, terpenes, natural oils or a combination thereof. Likewise, the solvent with low, medium or high polarity is selected from among glycols, glycol esters, alcohols, ketones, carboxylic acids, organic acids, water or a combination thereof.

Likewise, the liquid part may contain different additives that fulfil different functions. Among these additives we can differentiate binders, dispersing or hyper-dispersing agents, thixotropic anti-settling agents, wetting or moistening agents, levelling agents, anti-foaming agents and preservatives.

The binding agent facilitates the cohesion between the solvent molecules and the solid particles and, in those cases where it is used, a percentage by weight of the enamel/ink of no more than 10% is used. The binding agent is selected from between cellulose derivatives, polymers and acrylic copolymers, polyvinyl acrylates, polyvinyl alcohol, polyvinylpyrrolidones, polyvinyl acetates, polyamides, polyurethane and derivatives thereof, hydrocarbon resins, polyester resins, colophony resins, maleic resins, styrene resins, colophony esters, phenolic resins or combinations thereof.

The dispersing agent has the function of avoiding the agglomeration of the particles and, in those cases where it is used, it is found in the enamel/ink in a percentage by weight of no more than 5%. The dispersing agent is selected from between carboxylic acid derivatives, acrylic polymer derivatives, phosphates and their derivatives, silicates and their derivatives, polyamide or polyalkylamine derivatives, derivatives of polyether with amino groups, alkylamine salts and polymeric acid or a combination thereof.

In accordance with the present invention, the thixotropic anti-settling agent hampers the movement of the solid particles, preventing them from settling. When necessary, it is used in the enamel/ink in a percentage by weight of no more than 2%. The thixotropic anti-settling agent is selected from between carboxylic acid derivatives, acrylic polymer derivatives, phosphates and their derivatives, silicates and their derivatives, polyamide or polyalkylamine derivatives, derivatives of polyether with amino groups, alkylamine salts and polymeric acid, amine salts of sulphonic acids, urea-modified polyurethane, modified urea or combinations thereof.

The wetting or moistening agent modifies the surface tension of the liquid medium, thereby favouring the wetting of the surface of the solid particles by the solvent. It can be found in the enamel/ink in a percentage by weight of no more than 2% and is selected from between carboxylic acid co-polymers, polyesters, polyalkylammonium salts of carboxylic acids, polyether and polysiloxane derivatives or combinations thereof.

The levelling agent is essentially used in applications on non-porous substrates as in the case of glass and its function consists of reducing the roughness of the application. In accordance with the present invention, the levelling agent is found in the enamel/ink in a percentage by weight of no more than 2%. The levelling agent is selected from between polydimethylsiloxanes, polymethylalkylsiloxane, polymethylsiloxane-modified polyether or combinations thereof.

The anti-foaming agent prevents the formation of foam and, in those cases where it is used, it can be found in the enamel/ink in a percentage by weight of no more than 2%. The anti-foaming agent is selected from between polysiloxanes, and polysiloxanes with polyether or combinations thereof.

Lastly, agents that prevent the deterioration or decomposition of the liquid medium can also be used, known to any person skilled in the art, such as bactericides, fungicides, preservatives or similar, which can be found in the enamel/ink in a percentage by weight of no more than 2%. Isothiazolones, carbendazims, bronopols or other may be used as preservative agents.

DESCRIPTION OF THE FIGURES

As a complement to the description being made herein and for the purpose of helping make the characteristics of the invention more readily understandable, this specification is accompanied by a set of figures which, by way of illustration and not limitation, represent the following.

Figure 1:
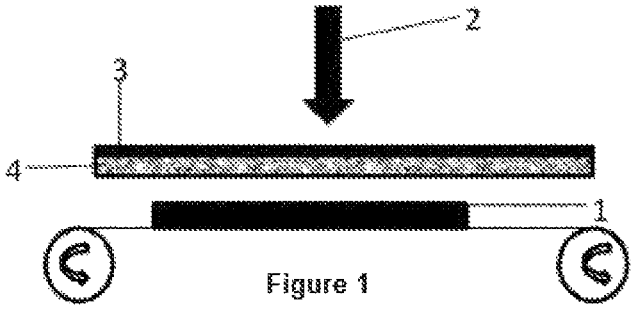
FIG. 1 shows a general diagram of the direct printing method according to the present invention. The energy-emitting device (2) strikes the enamel/ink (4) through the carrier vehicle (3), giving rise to a change in volume and/or position of the enamel/ink (4) and causing it to be deposited on the printing surface (1).
Figure 2:
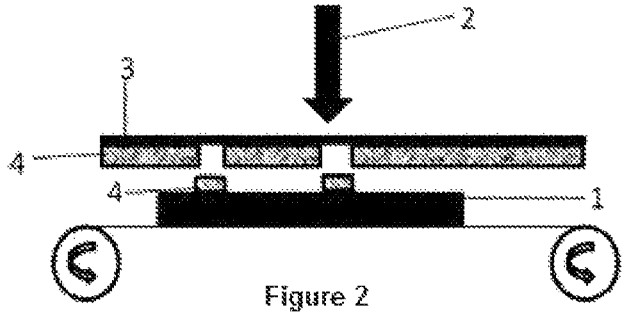
FIG. 2 shows a diagram of the direct printing method according to the present invention, wherein the change in volume and/or position of the enamel/ink (4) from the carrier vehicle (3) to the printing surface (1) is represented. The enamel/ink (4) may be deposited on certain zones of the printing surface (1), as represented in FIG. 2, or covering the entire printing surface (1).
Figure 3:
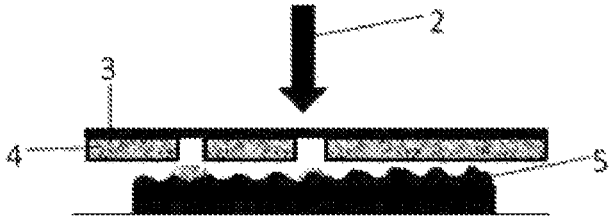
FIG. 3 shows a diagram of the direct printing method wherein the change in volume and/or position of the enamel/ink (4) from the carrier vehicle (3) to a raised printing surface (5) is represented. In accordance with the present invention, during this transfer process the distance between the enamel/ink (4) and the printing surface (5) is not less than 500 micrometers and not greater than 2.5 millimeters.
Figure 4:
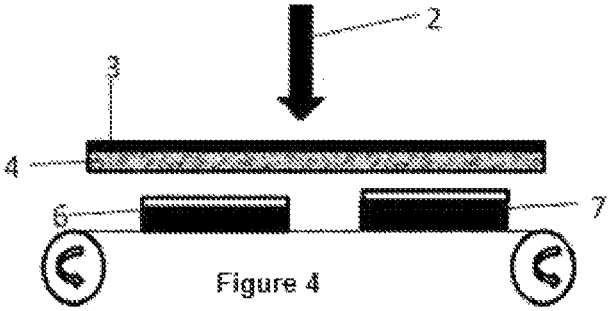
FIG. 4 shows a diagram of the direct printing method according to the present invention, wherein the variation in height of the ceramic substrates (6 and 7) due to the differences in thickness arising between different parts within the production process is represented.
Figure 5:
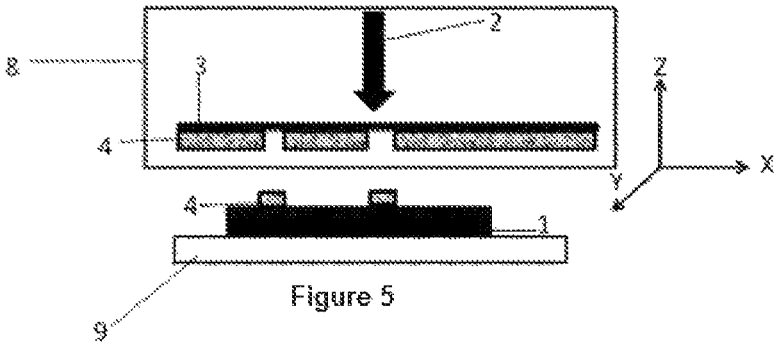
FIG. 5 shows a diagram of the direct printing method according to the present invention wherein the printing surface is fixed and the movement occurs in an XYZ coordinate system of the laser-carrier vehicle-enamel/ink system.
Figure 6:
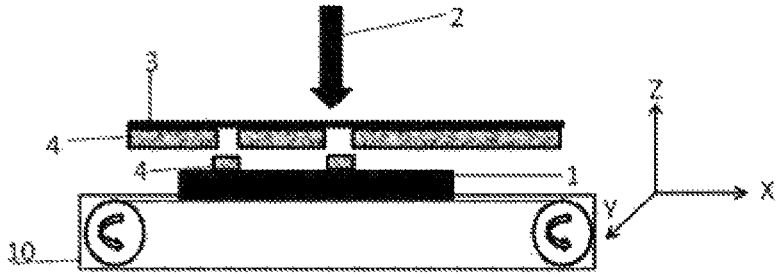
FIG. 6 shows a diagram of the direct printing method according to the present invention wherein the laser-carrier vehicle-enamel/ink system is fixed and the printing surface moves with movements in an XYZ coordinate system.

| List of references of the figures |
|---|
| 1 Printing surface. |
| 2 Energy-emitting device. |
| 3 Enamel/ink carrier vehicle. |
| 4 Enamel/ink. |
| 5 Raised printing surface. |
| 6 Ceramic substrate 1. |
| 7 Ceramic substrate 2 of greater height than ceramic substrate 1. |
| 8 Energy-emitting device-carrier vehicle-enamel/ink system with movement in an XYZ coordinate system. |
| 9 Support or bench for fixing the surface to be enamelled/decorated. |
| 10 Conventional transport system of the surface to be enamelled/decorated. |

PREFERRED EMBODIMENTS

In order to complete the description being made herein and with the object of helping to better understand its characteristics, this specification is accompanied by various exemplary embodiments of enamel/ink to provide designs with ceramic and chromatic effects, according to the invention. In all cases, a laser beam has been used as an energy-emitting device.

A preferred embodiment of the present invention is characterised in that it uses a laser beam as an energy-emitting device in the form of electromagnetic waves. In this way it is possible to focus a high amount of energy on a very small area of the enamel/ink, thereby producing drops to the order of picoliters and, therefore, a high quality in the printed image. In this regard, different types of lasers may be used, for example $CO_2$, He—Ne or Nd-YAG, among others. The different lasers are characterised, inter alia, by the wavelength or wavelength interval in which the energy beam is emitted, such as for example infrared, ultraviolet, green and red, among others, and by the energy emission mode, which may be continuous or pulsed. The selection of the type of laser according to the present invention shall be based on the composition of the enamel/ink to be applied.

All the exemplary embodiments are indicated by way of illustration and not limitation.

Compositions that Provide Ceramic Effects and their Properties

Examples 1, 2 and 3 correspond to enamels which enable the ceramic effects of the glazing layer to be obtained according to the invention. Specifically, example 1 provides an enamel with a glossy opaque effect, example 2 provides an enamel with a satin matt effect and example 3 provides an enamel with a glossy coloured effect.

The printing process of examples 1 to 3 has been carried out as follows. The printing surface moves in a conventional transport system while the laser-carrier vehicle-enamel system is fixed and in a transverse direction to that of the forward movement of said surface to be enamelled. In this regard, the system that transports the surfaces to be enamelled can reach speeds of up to 70 m/min. When the surface to be enamelled, which is moving, reaches the laser-carrier vehicle-enamel system, the laser emits an energy beam that penetrates the carrier vehicle and reaches the enamel. The incidence of said energy beam on the enamel is performed following a pattern or design so that, when the change in volume and/or position of the enamel in the form of bubbles occurs, these are deposited along the length and width of the surface to be enamelled in accordance with said pattern or design as the printing surface advances, without stopping at any time.

| Agent/function | Component | 1 | 2 | 3 |
|---|---|---|---|---|
| Frit 1 | Si, Al, Zn, K, Ca, Zr oxides | 47%-70% | | 42%-55% |
| Frit 2 | Si, Zn, Ca oxides | | 30%-45% | |
| Raw material 1 | $SiO_2$ | 3%-10% | | 3%-10% |
| Raw material 2 | Na feldspar | | 15%-20% | |
| Raw material 3 | $Al_2O_3$ | | 5%-10% | |
| Absorber | Graphite | <10% | <10% | <10% |
| Inorganic pigment | Blue - Cobalt Spinel Structure | | | 5%-15% |
| Solvent 1 | Glycol ether | 20%-25% | | 5%-25% |
| Solvent 2 | Water | | 20%-35% | |
| Binding 1 | Hydroxipropyl-cellulose | <10% | <10% | <10% |
| Binding 2 | Carboxymethyl-cellulose-starch co-polymer | <10% | | <10% |
| Dispersing 1 | Carboxylic acid co-polymers | <5% | <5% | <5% |
| Dispersing 2 | Acrylic polymer derivative | | <5% | |
| Thixotropic anti-settling agent | Modified urea | 2% | <2% | <2% |
| Wetting | Polyether-polysiloxane | 2% | <2% | <2% |
| Preservative | Isothiazolones | 2% | <2% | <2% |
| Viscosity (cPs) | | 3000 | 5200 | 4000 |
| % solids | | >50% | >50% | >50% |
| D90 (micrometers) | | 40 | 20 | 20 |
| D50 (micrometers) | | 20 | 10 | 10 |
| Type of laser | | Infrared | Infrared | Infrared |

Compositions that Provide Chromatic Effects and their Properties

Examples 4 to 7 correspond to inks which enable chromatic effects to be obtained according to the invention.

The printing process of examples 4, 5 and 6 has been carried out in the following manner. The printing surface moves in a conventional transport system while the laser-carrier vehicle-ink system is fixed and in a transverse direction to that of the forward movement of said surface to be decorated. In this regard, the system for transporting the surfaces to be decorated can reach speeds of up to 70 m/min. When the surface to be decorated that is moving reaches the laser-carrier vehicle-ink system, the laser emits an energy beam that penetrates the carrier vehicle and reaches the ink. The incidence of said energy beam on the ink is performed following a pattern or design so that, when the change in volume and/or position of the ink in the form of bubbles occurs, they are deposited along the length and width the surface to be decorated in accordance with said pattern or design as the printing surface advances, without stopping at any time.

The printing method of example 7 consists firstly of placing the surface to be decorated on a support or bench in order to immobilise it. Next, the laser-carrier vehicle-ink system is placed over the printing surface and the laser begins to emit an energy beam that penetrates the carrier vehicle and reaches the ink. The incidence of the energy beam on the ink is performed following a pattern or design so that, when the change in volume and/or position of the ink in the form of bubbles occurs, they are deposited on the surface to be decorated in accordance with said pattern or design. In order to deposit all the design or pattern on the printing surface, it remains immobile and the laser-carrier vehicle-ink system moves across the length and width of the printing surface along the XYZ coordinates, performing one or various passes over a same zone.

| Agent/function | Component | 4 | 5 | 6 | 7 |
|---|---|---|---|---|---|
| Inorganic pigment 1/ Absorber | Yellow - Praseodymium-doped Zr silicate structure | 70%-80% | | | |
| Inorganic pigment 2 | Black - Mixed Fe—Co—Ni—Cr oxide | | 75%-80% | | |
| Inorganic pigment 3 | Blue - Cobalt Spinel Structure | | | 50%-65% | |
| Inorganic pigment 4 | Pink - Cassiterite Structure | | | | 50%-65% |
| Absorber 1 | Graphite | | <10% | <5% | <10% |
| Absorber 2 | $Pr_6O_{11}$ | | | <5% | |
| Solvent 1 | Glycol ether | 20%-45% | 20%-45% | | |
| Solvent 2 | Water | | | | 25%-45% |
| Solvent 3 | Polyglycol | | | 25%-50% | 20%-25% |
| Dispersing agent 1 | Carboxylic acid polymers | <5% | <5% | <5% | |
| Dispersing agent 2 | Acrylic polymer derivative | | | | <5% |
| Binding agent 1 | Hydroxipropyl-cellulose | <10% | <10% | <10% | |
| Binding agent 2 | Carboxymethyl-cellulose-starch co-polymer | | | | <10% |
| Wetting agent | Polyether-polysiloxane | <2% | <2% | <2% | <2% |
| Anti-foaming agent | Polymethyl-alcoxysilane | | | | <2% |
| Thixotropic anti-settling agent | Modified urea | <2% | <2% | <2% | |
| Viscosity (cPs) | | 4600 | 5100 | 5400 | 8000 |
| % Solids | | >70% | >75% | >50% | >50% |
| D90 (micrometers) | | 7 | 10 | 9 | 18 |
| D50 (micrometers) | | 4 | 6 | 5 | 10 |
| Type of laser | | Ultraviolet | Infrared | Infrared | Infrared |

The characteristics disclosed in the description, figures and claims may be significant both separately and in any combination thereof for implementing the invention in its different embodiments.

The invention claimed is:

1. A direct printing method for enamelling and/or decorating on surfaces in general which are subjected to heat treatment following printing, comprising transferring an enamel/ink, by means of the use of a laser for emitting energy in the form of electromagnetic waves, from a carrier vehicle of the printing element to a printing surface, wherein:

the distance between the printing element and the printing surface is greater than 500 micrometers and less than 2.5 millimeters; and the viscosity of the enamel/ink is comprised between 500 cPs and 10,000 cPs.

2. The printing method, according to claim 1, wherein the printing surfaces are smooth and/or raised.

3. The printing method, according to claim 1, wherein the surfaces are ceramic and/or glass materials.

4. The printing method, according to claim 1, wherein the enamel/ink is deposited in selected zones of the printing surface and/or throughout the entire printing surface.

5. The printing method, according to claim 1, wherein the deposited weight of the enamel/ink is up to 500 g/m$^2$.

6. The printing method, according to claim 1, wherein the surfaces are fixed and the system comprising the energy-emitting device-carrier vehicle enamel/ink system moves in an XYZ coordinate system.

7. The printing method, according to claim 1, wherein the energy-emitting device-carrier vehicle enamel/ink system is fixed and the surfaces move by means of a transport system in a XYZ coordinate system.

8. The printing method, according to claim 1, wherein the energy-emitting device-carrier vehicle enamel/ink system moves along the Y-Z axes of an XYZ coordinate system and the surfaces are moved by means of a transport system on the X-axis of an XYZ coordinate system.

9. The printing method, according to claim 1, wherein the laser emits the laser light at a certain wavelength or in a wavelength interval.

10. The printing method, according to claim 1, wherein the enamel/ink comprises:

at least one solid part at room temperature, responsible for conferring the corresponding ceramic and/or chromatic effect, which comprises at least one solid substance that absorbs the energy emitted by the energy-emitting device, which is selected from between simple oxides, mixed oxides, crystalline structures of any structure or chemical composition, carbon, carbides, nitrides or a combination thereof, to transform said energy into heat and bring about a change in volume and/or position of the enamel/ink, and at least one liquid part at room temperature in a percentage by weight of between 20% and 50% in the enamel/ink.

11. The printing method, according to claim 10, wherein the solid part is found in the enamel/ink in a percentage by weight between 50% and 80% and it has a particle size of D90 that can reach 40 micrometers.

12. The printing method, according to claim 10, wherein the absorbing substance is found in the enamel/ink in a percentage by weight of no more than 10%.

13. The printing method, according to claim 10, wherein the liquid part comprises at least one binding agent which is found in the enamel/ink in a percentage by weight of no more than 10%.

14. The printing method, according to claim 10, wherein the liquid part comprises at least one dispersing agent which is found in the enamel/ink in a percentage by weight of no more than 5%.

15. The printing method, according to claim 10, wherein the liquid part comprises at least one thixotropic anti-settling agent which is found in the enamel/ink in a percentage by weight of no more than 2%.

16. The printing method, according to claim 10, wherein the liquid part comprises at least one wetting agent which is found in the enamel/ink in a percentage by weight of no more than 2%.

17. The printing method, according to claim 10, wherein the liquid part comprises at least one levelling agent which is found in the enamel/ink in a percentage by weight of no more than 2%.

18. The printing method, according to claim 10, wherein the liquid part comprises at least one anti-foaming agent which is found in the enamel/ink in a percentage by weight of no more than 2%.

19. The printing method, according to claim 10, wherein the liquid part comprises at least one enamel/ink containing preservatives in a percentage by weight of no more than 2%.

* * * * *